US006563035B2

(12) United States Patent
Hsieh

(10) Patent No.: US 6,563,035 B2
(45) Date of Patent: May 13, 2003

(54) FOLDING FRAME FOR SUPPORTING A MUSICAL INSTRUMENT

(76) Inventor: Wu-Hong Hsieh, No. 162, Chung Shan 2 nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 09/952,395

(22) Filed: Sep. 14, 2001

(65) Prior Publication Data

US 2002/0073823 A1 Jun. 20, 2002

(30) Foreign Application Priority Data

Dec. 14, 2000 (TW) ..... 89221674 U

(51) Int. Cl.[7] ..... G10D 3/00

(52) U.S. Cl. ..... 84/327; 84/421

(58) Field of Search ..... 84/327, 421

(56) References Cited

U.S. PATENT DOCUMENTS 5,375,497 A * 12/1994 Pirchio et al. ..... 248/443
5,505,413 A * 4/1996 Hennessey ..... 248/166
6,326,531 B1 * 12/2001 Bremner ..... 84/327

* cited by examiner

*Primary Examiner*—Kim Lockett
(74) *Attorney, Agent, or Firm*—Alan D. Kamrath; Rider, Bennett, Egan & Arundel

(57) ABSTRACT

A folding frame for supporting a musical instrument is disclosed. The frame includes a first leg and a second leg pivotally connected to each other. The first leg is formed with a disk defining a plurality of holes. The second leg is formed with a spring-loaded pin that tends to be moved into one of the holes in the disk. A handle is pivotally connected to the second leg, and has a first end spaced from the second leg and a second end engaged with the pin. Therefore, the pin can be moved out of one of the holes in the disk simply by pressing the first end of the handle towards the second leg.

1 Claim, 5 Drawing Sheets

FOLDING FRAME FOR SUPPORTING A MUSICAL INSTRUMENT

BACKGROUND OF THE INVENTION

1. Field of the Invention

The present invention relates to a folding frame for supporting a musical instrument and, more particularly, to a folding frame which is easy to be adjusted.

2. Description of Related Art

There are various kinds of musical instruments. Some of them, such as a portable electronic organ and probably an electric guitar, are supported on frames while being played. As shown in FIGS. 4 and 5, one known frame, in folding configuration for this purpose, includes a pair of legs (80,90) pivotally connected to each other about a pivot (89), with the first leg (80) formed with a disk (82) defining a plurality of holes (84) therein.

As shown in FIG. 5, the second leg (90) is formed with a spring-loaded pin (92) that tends to be moved into one of the holes (84) in the disk (82), under the action of a helical spring (94). Additionally, a knob (922) is attached to an end (920) of the pin (92) opposed to the disk (82).

This folding frame is adjusted by moving the pin (92) out of the hole (84) in the disk (82) by pulling the knob (922). Then the legs (80,90) can be turned with respect to each other to a desired position, in which the pin (92) may be moved into another hole (84) soon after the knob (922) is released.

However, it has been found that the folding frame of this type is difficult to be adjusted, since a third hand is usually required to pull the knob (922) in addition to the two hands that grip and turn the legs (80,90), respectively.

Therefore, it is an objective of the invention to provide a folding frame to mitigate and/or obviate the aforementioned problem.

SUMMARY OF THE INVENTION

The object of the present invention is to provide a folding frame which is easy to be adjusted.

Other objects, advantages and novel features of the invention will become more apparent from the following detailed description when taken in conjunction with the accompanying drawings.

DETAILED DESCRIPTION OF THE PREFERRED EMBODIMENT

Figure 1:
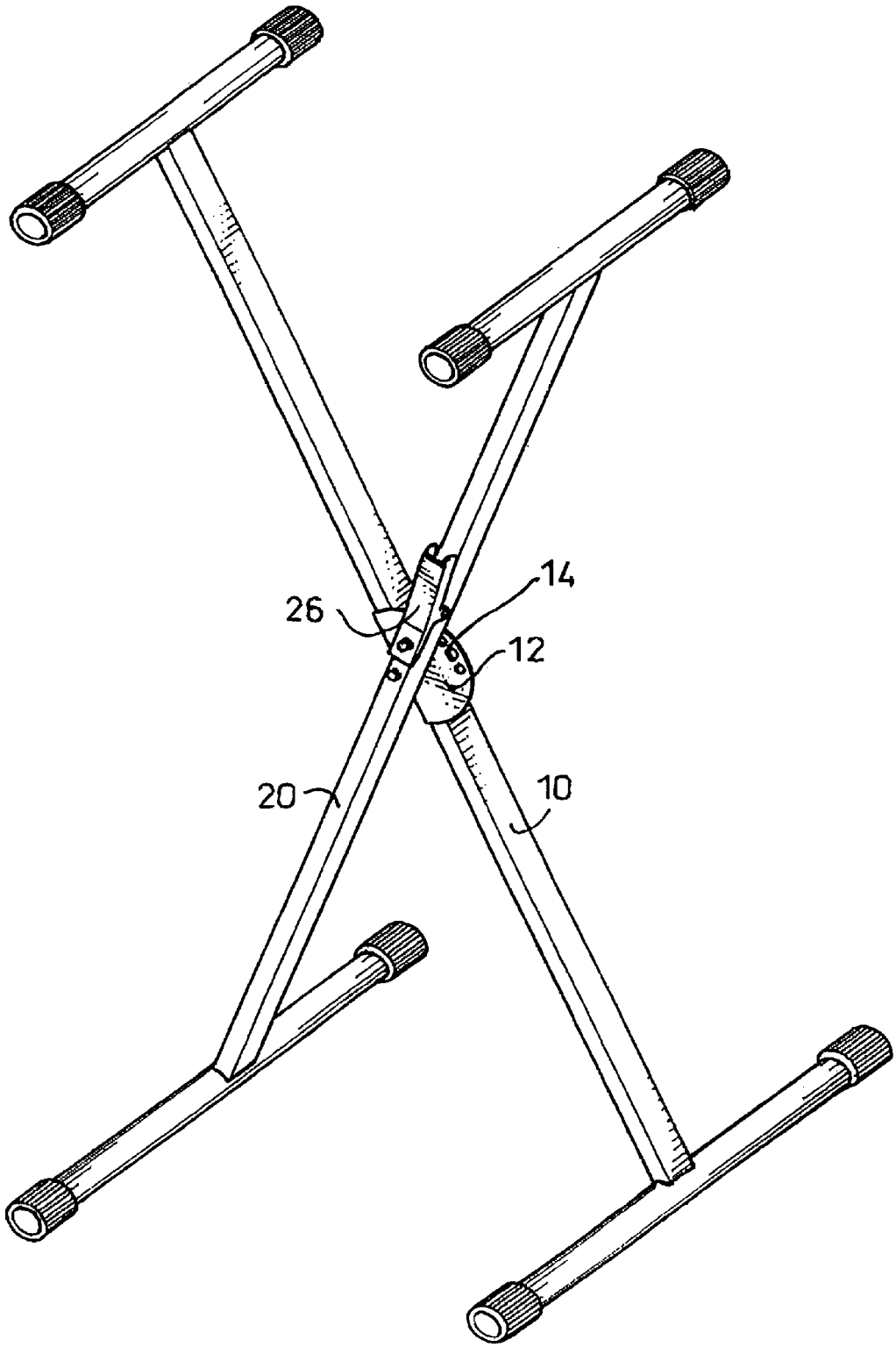
FIG. 1 is a perspective view of a first embodiment of a folding frame in accordance with the present invention.

Referring to FIG. 1, there is shown a first embodiment of a folding frame in accordance with the present invention configured to support a musical keyboard. The frame includes a first leg (10) and a second leg (20) pivotally connected to each other.

The first leg (10) is formed with a disk (12) defining a plurality of holes (14), and the second leg (20) is formed with a handle (26).

Figure 2:
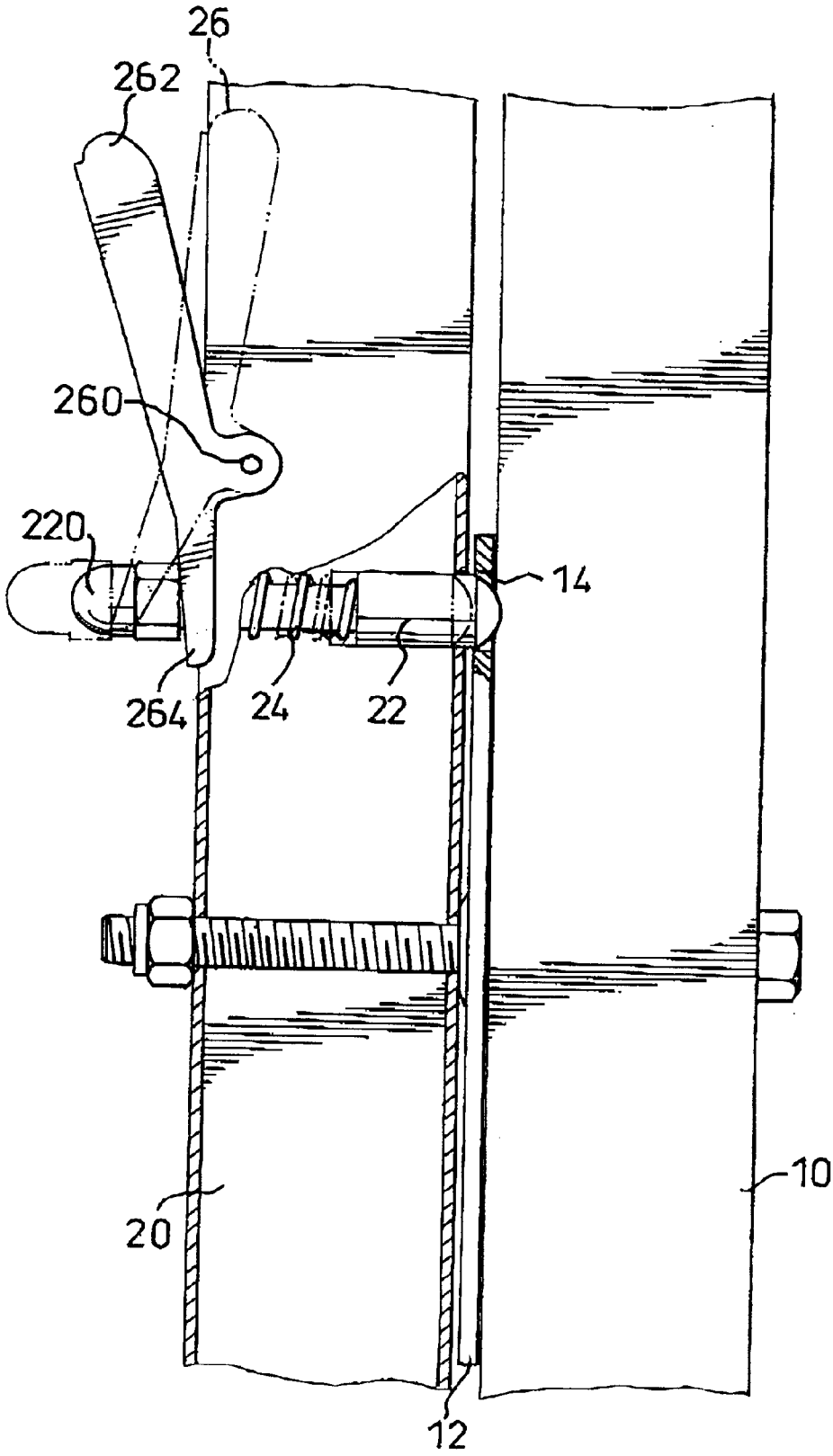
FIG. 2 is an enlarged, fragmentary cross-sectional view of the folding frame shown in FIG. 1.

Referring to FIG. 2, the second leg (20) has a spring-loaded pin (22) that tends to be moved into one of the holes (14) in the disk (12), under the action of a helical spring (24). The pin (22) has an enlarged end (220) opposed to the disk (12).

The handle (26) is pivotally connected to the second leg (20) about a pivot (260). The handle (26) has a first end (262) spaced from the second leg (20), and a second end (264) engaged with the pin (22) at the enlarged end (220).

In this configuration, the inventive frame can be easily adjusted simply by grasping the first leg (10) with one hand, while grasping the second leg (20) and pressing the first end (262) of the handle (26) towards the same leg (20) with the other hand. The pin (22) is then moved out one of the holes (14) of the disk (12) into another, so as to adjust the frame as desired.

Figure 3:
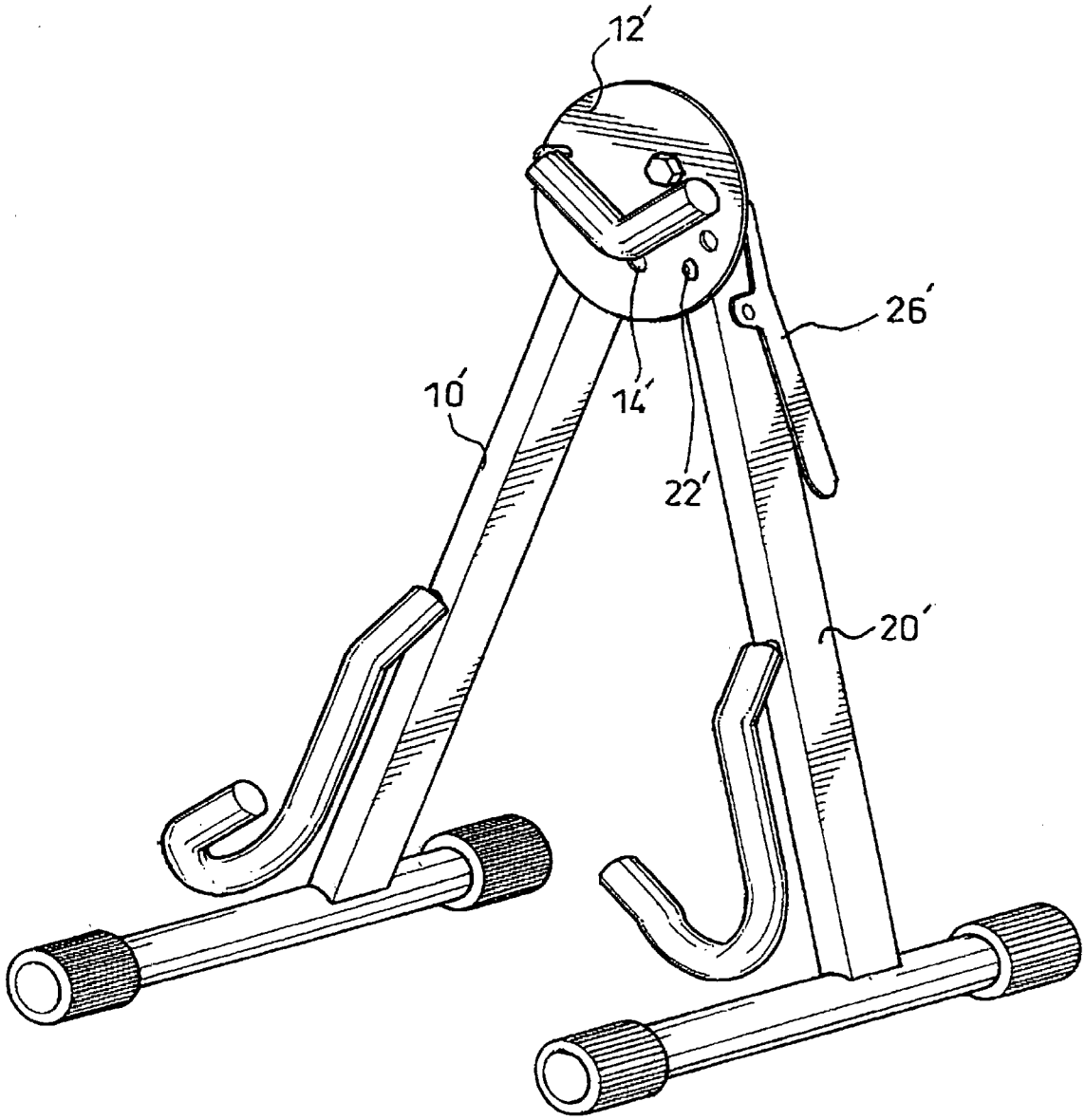
FIG. 3 is a perspective view of a second embodiment of the folding frame in accordance with the present invention.
Figure 4:
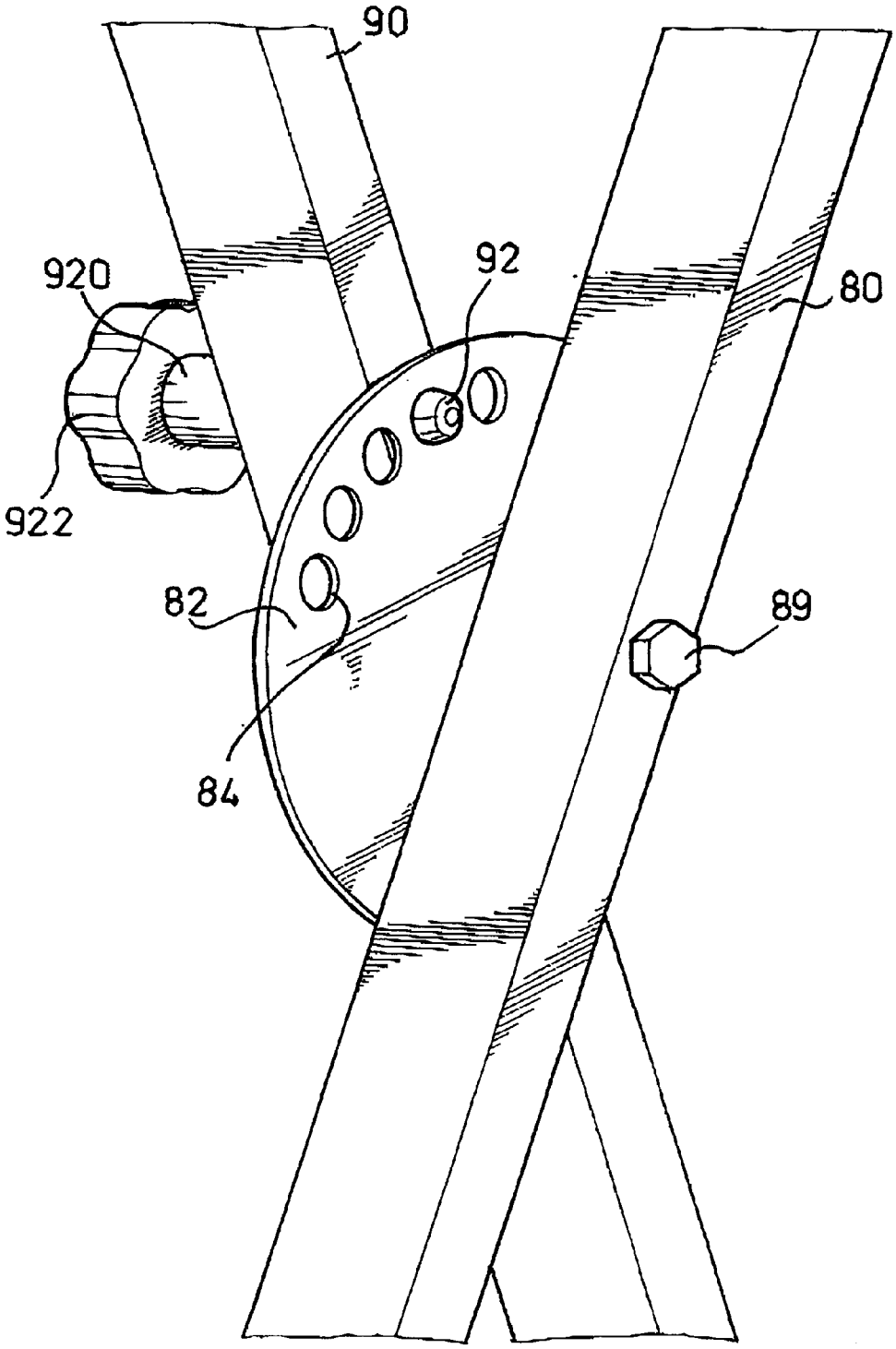
FIG.4 PRIOR ART
FIG. 4 is a fragmentary perspective view of a conventional folding frame for supporting a musical instrument.
Figure 5:
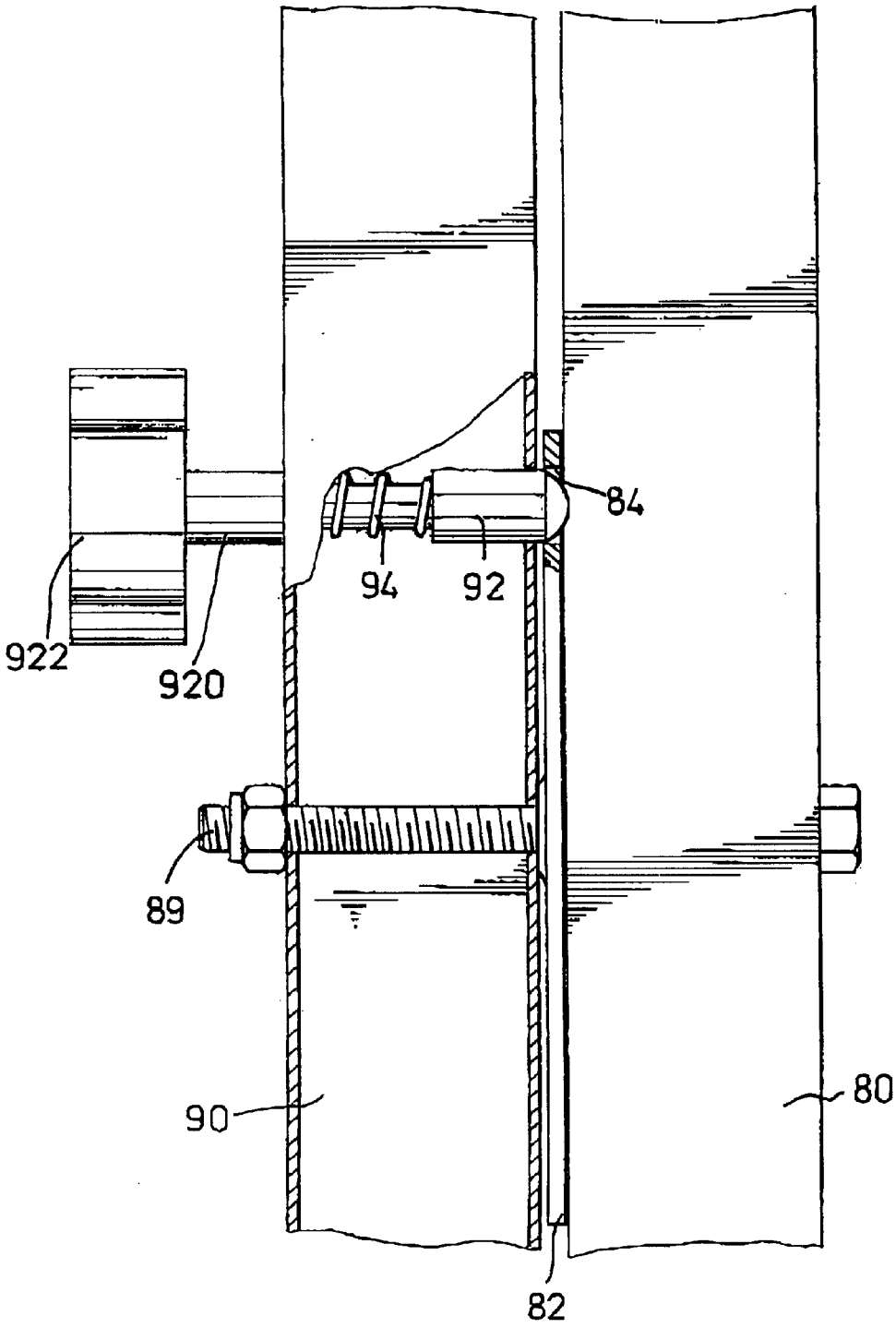
FIG.5 PRIOR ART
FIG. 5 is a fragmentary cross-sectional view of the conventional folding frame shown in FIG. 4.

Referring to FIG. 3, there is shown a second embodiment of the folding frame in accordance with the present invention configured to support an electric guitar. This frame includes a first leg (10') and a second leg (20') pivotally connected to each other, with the first leg (10') formed with a disk (12') at a common top of the legs (10,20). The disk (12') also defines a plurality of holes (14') therein.

Pivotally connected to the second leg (20') is a handle (26') that may move a spring-loaded pin (22') out one of the holes (14') in the disk (12') when it is operated, and may allow the pin (22') to be moved into the same or another hole (14') in the disk (12') when it is released, in the same manner as mentioned above in the first embodiment.

From the above description, it is noted that the invention has the advantage of easy adjustment by grasping the first leg (10) with one hand, white grasping the second leg (20) and pressing the first end (262) of the handle (26) towards the same leg (20) with the other hand.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a folding frame for supporting a musical instrument, said folding frame comprising:

a first leg and a second leg pivotally connected to each other in an X-shaped manner about a pivot axis, said first leg being formed with a disk defining a plurality of holes radially spaced from and extending parallel to the pivot axis, said second leg being formed with a spring-loaded pin tending to be moved into one of said holes in said disk;

a handle adapted to be pivotally connected to said second leg, with the handle having a first end and a second end engaged with said pin, and a pivot located intermediate the first and second ends of the handle and about which said handle is pivotally connected to said second leg, with the pivot extending generally perpendicular to the pivot axis, whereby said pin may be moved out of one of said holes in said disk by pressing said first end of the handle towards said second leg.

* * * * *